US006634124B1

(12) United States Patent
Bierschbach

(10) Patent No.: US 6,634,124 B1
(45) Date of Patent: Oct. 21, 2003

(54) SIGN DISPLAY WITH AN INTERNAL INFRARED COMMUNICATION SYSTEM

(75) Inventor: Daniel J. Bierschbach, Watertown, SD (US)

(73) Assignee: Daktronics, Inc., Brookings, SD (US)

( * ) Notice: Subject to any disclaimer, the term of this patent is extended or adjusted under 35 U.S.C. 154(b) by 0 days.

(21) Appl. No.: 09/971,502

(22) Filed: Oct. 4, 2001

(51) Int. Cl.[7] ..... G09F 3/04
(52) U.S. Cl. ..... 40/452; 40/576; 40/605
(58) Field of Search ..... 40/452, 447, 573, 40/576, 605

(56) References Cited

U.S. PATENT DOCUMENTS 4,532,579 A * 7/1985 Merryman ..... 40/452 X
5,020,253 A * 6/1991 Lie et al. ..... 40/576
5,088,221 A * 2/1992 Bussiere et al. ..... 40/618
5,159,772 A * 11/1992 Akaley ..... 40/605 X
5,184,116 A * 2/1993 Daugherty et al. ..... 40/447 X
5,283,595 A * 2/1994 Krukovsky ..... 40/606 X
5,839,816 A * 11/1998 Varga et al. ..... 362/800 X
5,897,194 A * 4/1999 Ham ..... 40/570 X
6,088,008 A * 7/2000 Reeder ..... 40/447 X
6,243,690 B1 * 6/2001 Adamec et al. ..... 40/447 X
6,314,669 B1 * 11/2001 Tucker ..... 40/452 X

* cited by examiner

*Primary Examiner*—Joanne Silbermann
(74) *Attorney, Agent, or Firm*—Hugh D. Jaeger

(57) ABSTRACT

An electronic sign display having an internal infrared communication system, includes a plurality of display panels each of which includes an infrared receiver and an infrared transmitter for passage of data information. The display panels slidingly align along a front panel. Each display panel is linked to an adjacent display panel by an infrared data link, and information received therefrom is displayed upon the appropriate display panel.

41 Claims, 4 Drawing Sheets

SIGN DISPLAY WITH AN INTERNAL INFRARED COMMUNICATION SYSTEM

CROSS REFERENCES TO RELATED APPLICATIONS

None.

BACKGROUND OF THE INVENTION

1. Field of the Invention

The present invention is for a sign display and, more particularly, is an electronic sign display having an internal infrared communication system.

2. Description of the Prior Art

Prior art electronic sign displays have been provided and used often to display information in stadiums, arenas, large halls, and the like. Often the electronic sign displays have been mounted at the edge of a ring or balcony structure above the first floor level at a position and level highly viewable to participants. Servicing of the electronic sign displays often required the use of access devices such as ladders, cherry pickers, elevating devices or other elaborate and expensive devices due to the elevated position of the electronic sign display on the ring structure. Often seating structures offered ground level interference for the usage of these service devices. Other problems encountered with the servicing of the electronic sign displays were that the rearward side of the electronic sign display structure was mounted to a flat elevated mounting surface and servicing required access through the back of the unit, thereby requiring removal of the sign from the mounting surface. Removal of the sign could be accomplished by the use of the access devices or by physically removing the sign structure or part of the sign structure while standing in the balcony or ring in a position adjacent to the electronic sign display at the edge of the ring. Another problem encountered with prior art electronic sign displays was that the changing of numerous hardwired connections was laborious and time consuming. Clearly what is needed is an electronic sign display which does not require expensive, cumbersome or dangerous methods for access and which also minimizes the time spent replacing or servicing the electronic sign display.

SUMMARY OF THE INVENTION

The general purpose of the present invention is a sign display with an internal infrared communication system.

According to one embodiment of the present invention, there is provided a sign display with an internal infrared communication system. A plurality of aligned display panels having LEDs are located on the front panel of an enclosure to display information. Each display panel slidingly engages channels located in the front panel for adjacent positioning along the front panel. A hinged access door above each display panel can be opened to provide vertical access to the display panel so that the display panel can be sliding disengaged in a vertical fashion from the front panel. Each display panel includes a rearwardly located infrared receiver and infrared transmitter for communicatingly transmitting information from one display panel to the adjacent display panels. A master infrared transmitter adjacent to one end of the aligned display panels transmits information to an adjacent display panel which is subsequently distributed along the infrared receivers and transmitters located on each display panel to provide information for the display image shown on each display panel.

One significant aspect and feature of the present invention is a sign display with an internal infrared communication system where information is directed along a series of adjacent display panels to provide output data for each display panel.

Another significant aspect and feature of the present invention is the use of individual display panels which slidingly engage channels in a front panel of an enclosure.

Still another significant aspect and feature of the present invention is access doors on the enclosure top panel which provide access to each display panel.

Yet another significant aspect and feature of the present invention is sign display with an internal infrared communication system which is easily accessible from the top.

Having thus described an embodiment of the present invention and enumerated some of the significant aspects and features thereof, it is the principal object of the present invention to provide a sign display with an internal infrared communication system.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

Figure 1:
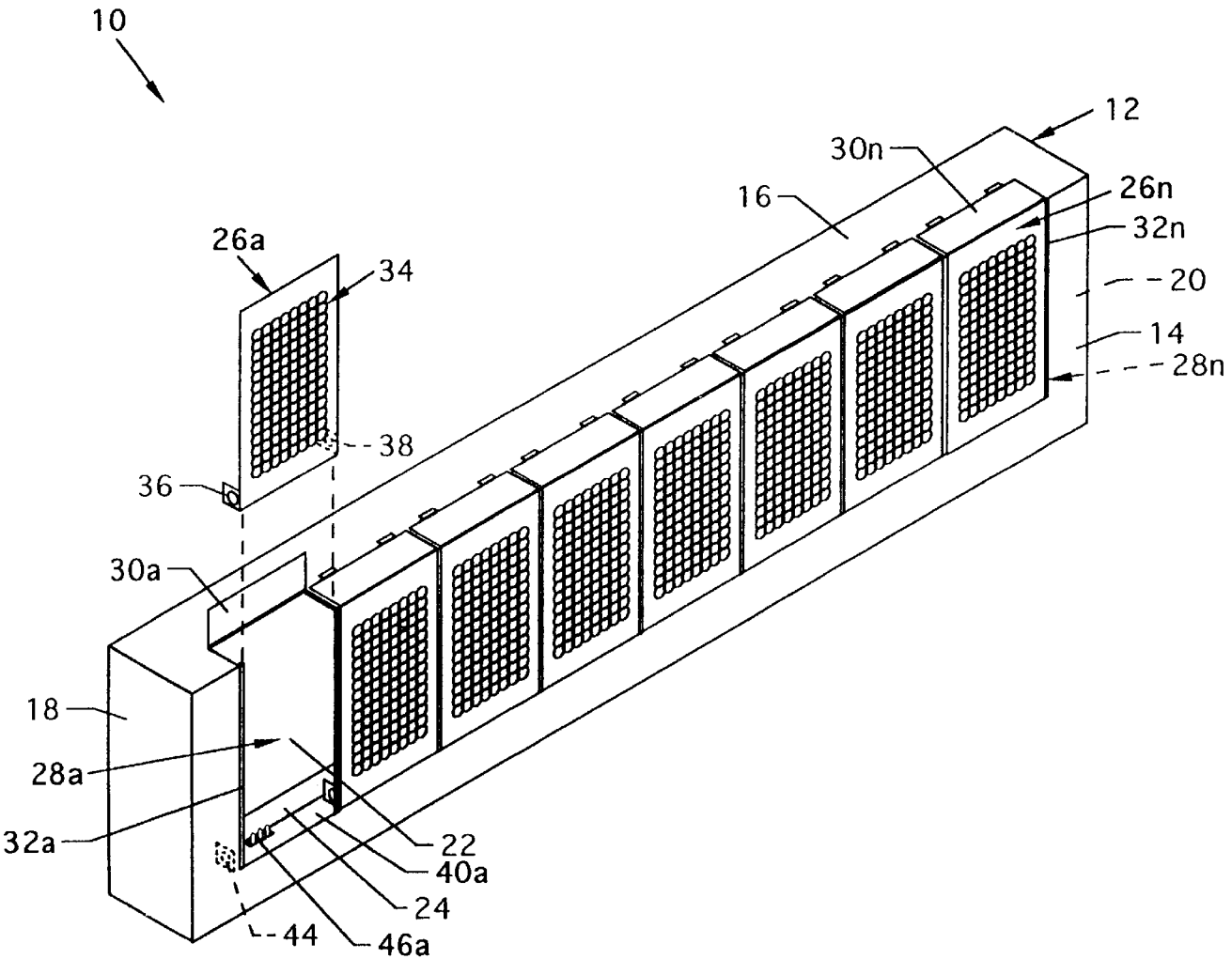
FIG. 1 illustrates an isometric view of a sign display with an internal infrared communication system, the present invention.

FIG. 1 illustrates an isometric view of a sign display with an internal infrared communication system 10, the present invention. An enclosure 12 includes a front panel 14, a top panel 16, end panels 18 and 20, a removable back panel 22, and a bottom panel 24. A plurality of display panels 26*a*–26*n* are adjacently located along the front panel 14 for dissemination of information provided by light emitting diodes (LEDs) or other light emitting devices. Display panel 26*a* is shown removed from the front panel 14 as it would be for changeout or repair, thereby revealing the structure to which the display panel 26*a* slidingly engages as well as showing an opening 28*a* to which the display panel 26*a* and a hinged access door 30*a* align. Openings 28*a*–28*n* extend vertically along the front panel 14 and horizontally along the top panel 16. Hinged access doors 30*a*–30*n* align adjacently along the top panel 16 in alignment with the respective openings 28*a*–28*n* and with and over and about the tops of the display panels 26*a*–26*n*. A plurality of vertically aligned channels 32*a*–32*n* extend downwardly along the front panel 14 to define the vertical component of the openings 28*a*–28*n* and to slidingly accommodate the display panels 26*a*–26*n*. Each display panel 26*a*–26*n* includes an LED display matrix 34, an infrared receiver 36, and an infrared transmitter 38. A plurality of stop brackets 40*a*–40*n*, of which only stop bracket 40*a* is shown in FIG. 1, extend inwardly from the lower edges of the openings 28*a*–28*n*. Correspondingly, a horizontally extending support panel 42 (shown in FIG. 2) extends from the lower region of each display panel 26*a*–26*n* to impinge upon the respective stop brackets 40*a*–40*n*, thereby limiting the downward descent and providing for vertical alignment of each display panel 26*a*–26*n* in the channels 32*a*–32*n*.

Figure 2:
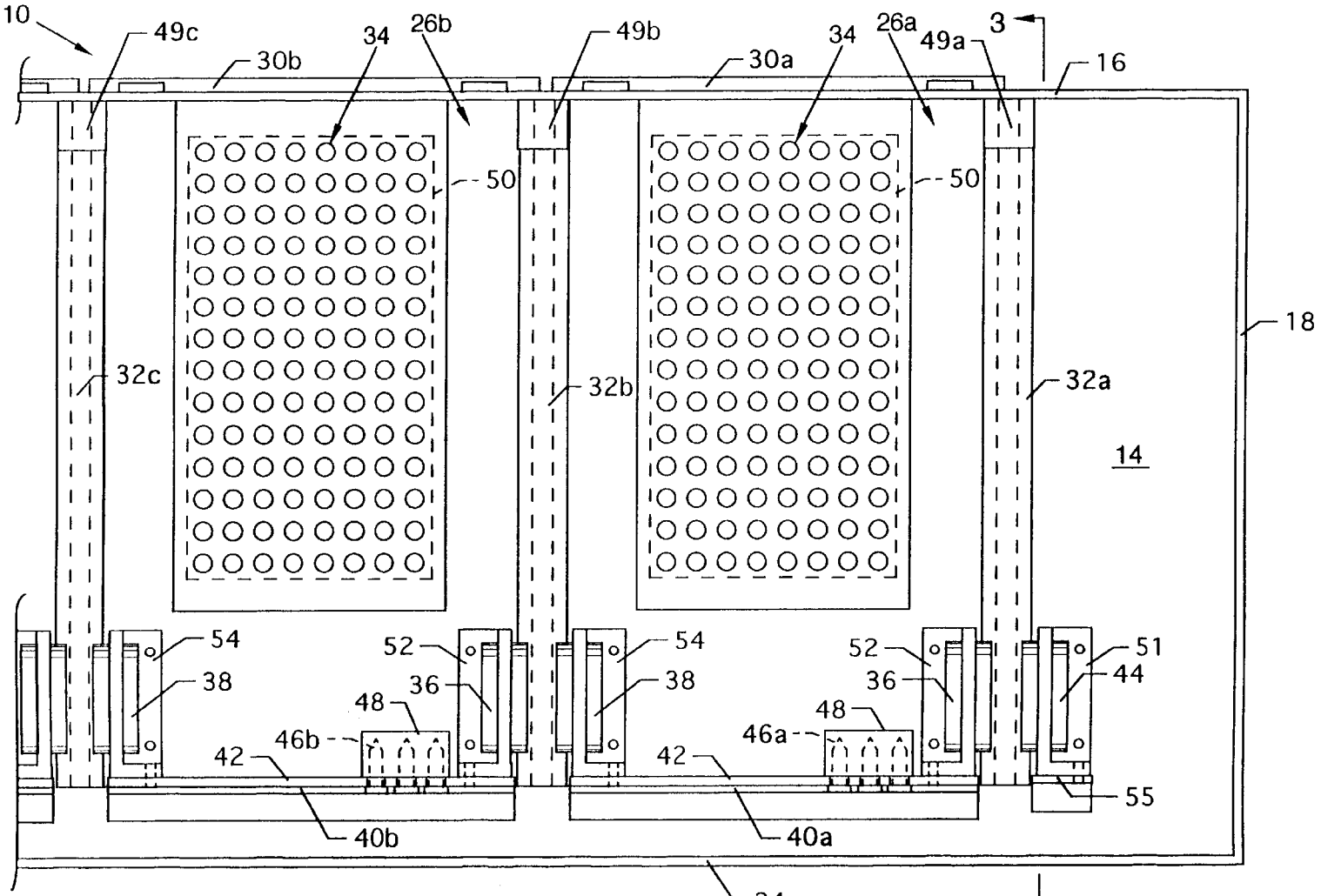
FIG. 2 illustrates a rear view of the sign display with an internal infrared communication system.

FIG. 2 illustrates a rear view of the sign display with an internal infrared communication system 10, where all numerals mentioned previously correspond to those elements previously described. Illustrated in dashed lines are apertures 50 located in each of the display panels 26*a*–26*n* through which the associated LED display matrix 34 is visible on the opposite side of the front panel 14. A plurality of horizontally oriented support bars 49*a*–49*n*, of which 49*a*–49*c* are shown, align along the undersurface of the top panel 16. The support bars 49*a*–49*n* provide support for the channels 32*a*–32*n* and also define a portion of the openings 28*a*–28*n*. Also visible are brackets 52 and 54 secured to the rear sides of the display panels 26*a*–26*n*. Brackets 52 and 54 serve as mounts for the support panels 42, and each bracket 52 and 54 also serves as a mount for an infrared receiver 36 and an infrared transmitter 38, respectively. Also shown is a bracket 51 secured to the rear side of the front panel 14 which serves as a mount for a support panel 55 and a master infrared transmitter 44 which is for transmitting of desired infrared data information to the infrared receiver 36 on the first display panel 26*a*. Infrared data information for display is detected and then displayed on the display matrix 34 of the display panel 26*a*. Data information is passed on and retransmitted by the infrared transmitter 38 on the first display panel 26*a* to the infrared receiver 36 on the second display panel 26*b* where data information is detected and displayed on the display matrix 34 of the display panel 26*b*. Such data is received, detected, displayed, and retransmitted along each of the display panels 26*a*–26*n* from one to the other in succession. Although infrared receivers 36 and transmitters 38 are shown as separate units, combined infrared receivers and transmitters could be incorporated as a single unit, and the use thereof shall not be construed to be limiting to the scope of the invention. Also shown is a female connector block 48 secured to each support panel 42 of the display panels 26*a*–26*n* for connecting supply voltage to each of the display panels 26*a*–26*n* via male pin connector blocks 46*a*–46*n* carried by the stop brackets 40*a*–40*n*.

Figure 3:
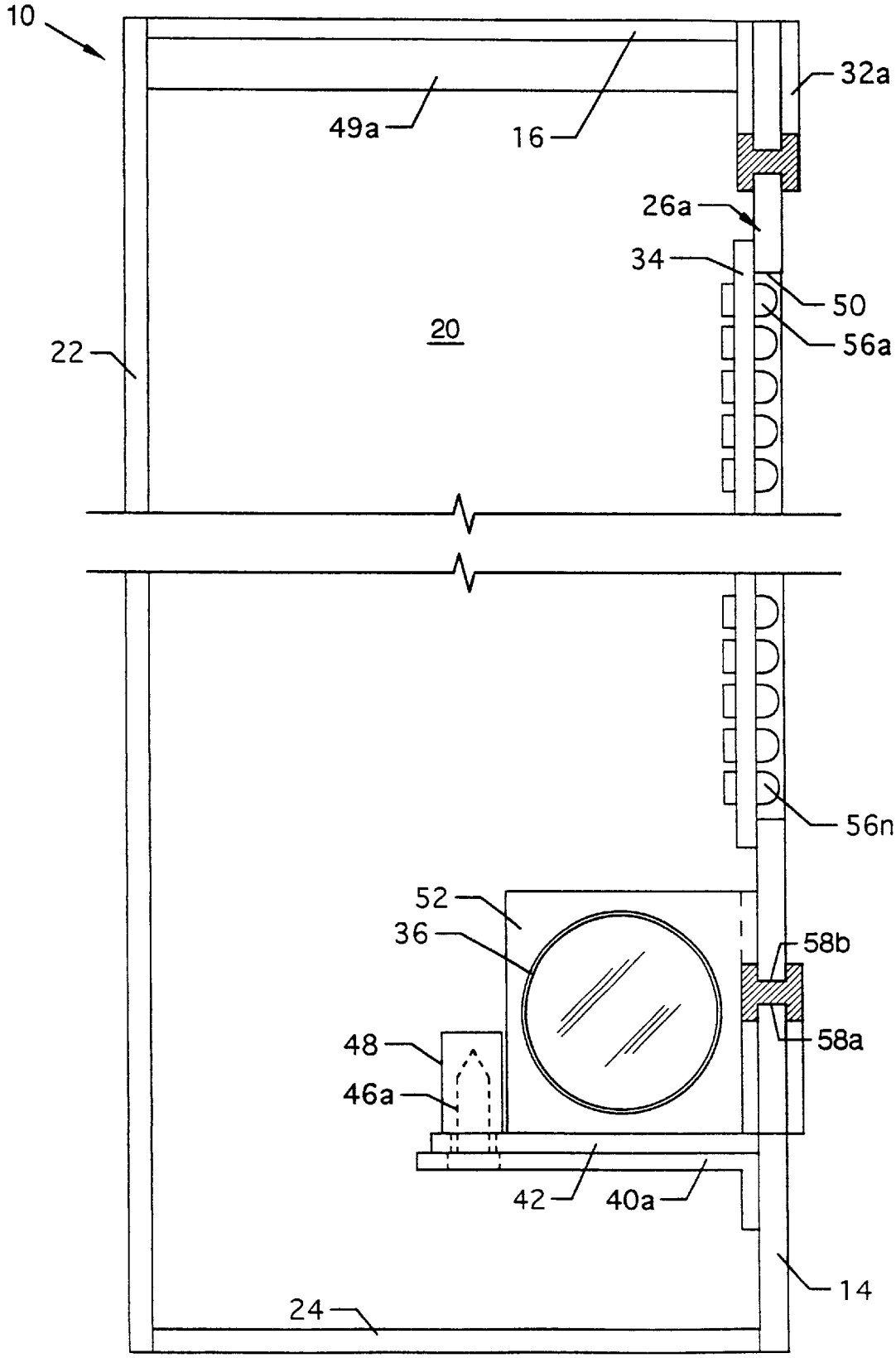
FIG. 3 illustrates an end view, in partial cutaway, of the sign display with an internal infrared communication system generally along line 3—3 of FIG. 2; and, FIG. 4 illustrates a top view of the sign display with an internal infrared communication system showing the engagement of the display panels with a channel.

FIG. 3 illustrates an end view, in partial cutaway, of the sign display with an internal infrared communication system 10 generally along line 3—3 of FIG. 2, where all numerals mentioned previously correspond to those elements previously described. Also shown is the plurality of LEDs 56*a*–56*n* of the LED display matrix 34 viewable through the aperture 50.

Figure 4:
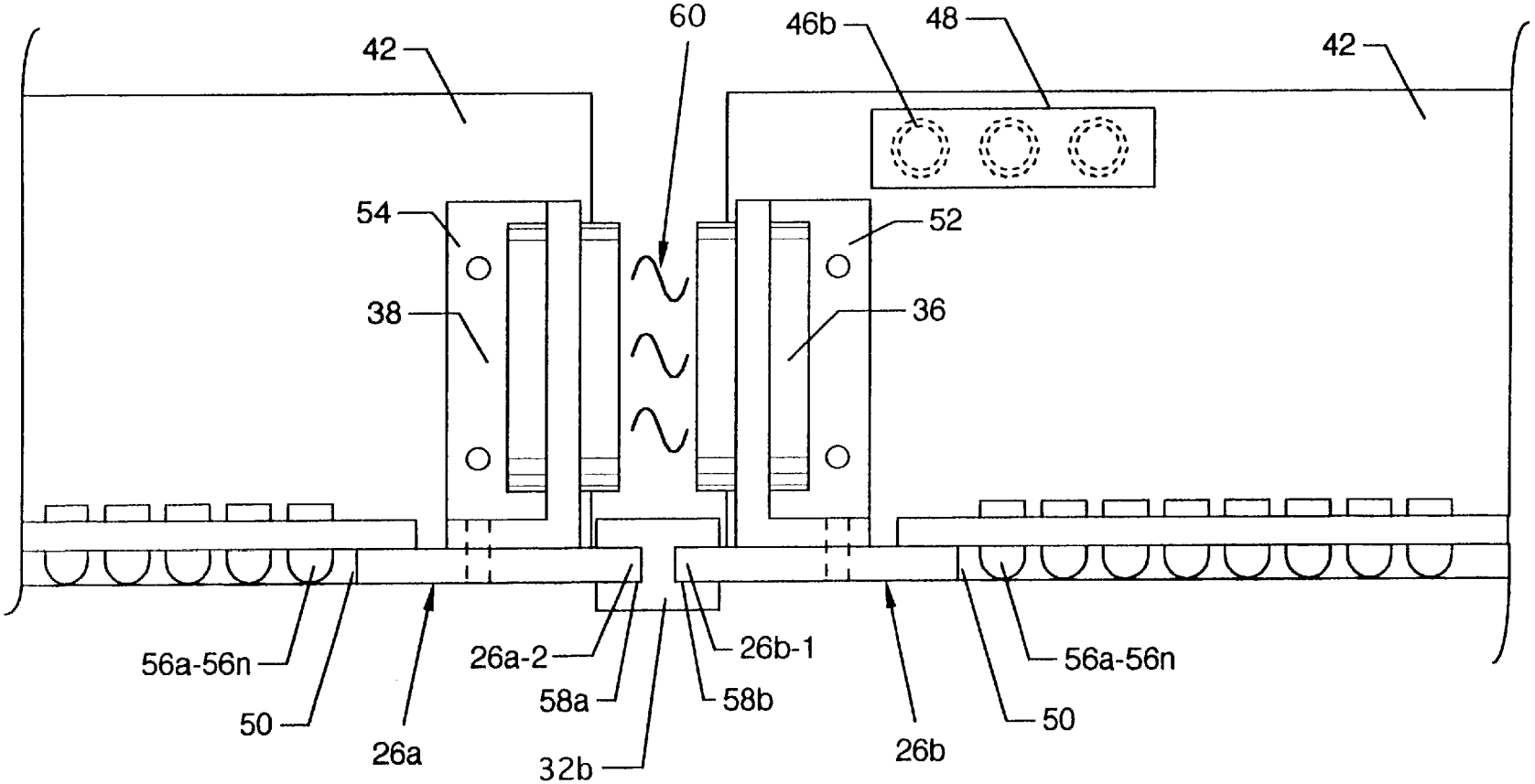

FIG. 4 illustrates a top view of the sign display with an internal infrared communication system 10 showing the engagement of the display panels 26*a*–26*b* with a channel 32*b*, where all numerals mentioned previously correspond to those elements previously described. Channel 32*b* is representative of channels 32*a* and 32*c*–32*n*, which are of similar construction, each including opposing channels 58*a* and 58*b* for sliding engagement with each of the display panels 26*a*–26*n*. The edge 26*a*-2 of the display panel 26*a* slidingly engages channel 58*a*, and the edge 26*b*-1 of the display panel 26*b* slidingly engages channel 58*b*. Display panels 26*a*–26*n* slidingly engage the channels 32*a*–32*n* and contact the stop brackets 40*a*–40*n* (shown in FIG. 2), whereby the infrared transmitters 38 and infrared receivers 36 are brought into mutual alignment, as also shown in FIG. 2. Data link transmission and reception of infrared information 60 between the infrared transmitter 38 and the infrared receiver 36 is shown.

Various modifications can be made to the present invention without departing from the apparent scope hereof.

| PARTS LIST | |
|---|---|
| 10 | sign display with an internal infrared communication system |
| 12 | enclosure |
| 14 | front panel |
| 16 | top panel |
| 18 | end panel |
| 20 | end panel |
| 22 | back panel |
| 24 | bottom panel |
| 26a-n | display panels |
| 26a-2 | edge |
| 26b-1 | edge |
| 28a-b | openings |
| 30a-n | access doors |
| 32a-n | channels |
| 34 | display matrix |
| 36 | infrared receiver |
| 38 | infrared transmitter |
| 40a-n | stop brackets |
| 42 | support panel |
| 44 | master infrared transmitter |
| 46a-n | male pin connector blocks |
| 48 | female connector block |
| 49a-n | support bars |
| 50 | aperture |
| 51 | bracket |
| 52 | bracket |
| 54 | bracket |
| 55 | support panel |
| 56a-n | LEDs |
| 58a-b | channels |
| 60 | infrared information |

What is claimed is:

1. An electronic sign system comprising:

a. an enclosure with a plurality of display panels and an end panel;

b. a master infrared communications module next to said end panel of said enclosure; and, c. a corresponding infrared module on each of said displays panels of the plurality of display panels for communication with said master infrared communications module in a daisy chain manner.

2. The electronic sign system of claim 1, wherein the corresponding infrared module on each of the display panels includes an infrared receiver and an infrared transmitter.

3. The electronic sign system of claim 2, wherein the infrared receiver of the corresponding infrared module on each display panel is directed to receive an infrared signal arriving at the infrared receiver and wherein the infrared transmitter of the corresponding infrared module on each display panel is directed to transmit an infrared signal to a successive display panel of the plurality of display panels.

4. The electronic sign system of claim 1, wherein each display panel of the plurality of display panels detects infrared data information and displays detected data information on a display matrix.

5. The electronic sign system of claim 1, wherein the display panels of the plurality of display panels are linearly arranged within the enclosure.

6. The electronic sign system of claim 1, wherein the display panels are horizontally arranged within the enclosure.

7. The electronic sign system of claim 1, wherein each display panel of the plurality of display panels is interchangeable with other display panels of the plurality of display panels.

8. The electronic sign system of claim 1, wherein each display panel of the plurality of display panels is separable from the enclosure and from the remaining display panels of the plurality of display panels.

9. The electronic sign system of claim 8, wherein each of the display panels of the plurality of display panels is removable from the enclosure by sliding out of engaged alignment with the enclosure and the plurality of display panels of the enclosure.

10. The electronic sign system of claim 9, wherein the sliding out of engaged alignment includes a vertical motion.

11. The electronic sign system of claim 10, wherein each display panel is connected to power through a male/female pin connector when in engaged alignment.

12. The electronic sign system of claim 11, wherein the male/female connector includes a female connector block carried on each of the display panels and a male pin connector block carried by the enclosure for each display panel of the plurality of display panels.

13. The electronic sign system of claim 12, wherein the male/female connector is arranged for vertical separation and the male pin connector block is carried by a stop bracket within the enclosure.

14. The electronic sign system of claim 13, wherein the stop bracket limits vertical sliding of a display panel and provides engaged alignment of a display panel with the enclosure.

15. The electronic sign system of claim 1, wherein the enclosure has a plurality of openings, each of the openings having a pair of opposed vertically oriented channels for vertically slidingly accepting a display panel from the plurality of display panels and a lower stop bracket, the lower stop bracket carrying a vertically oriented male pin connector block and wherein each display panel carries a female connector block, such that a display panel may vertically slide downward on the channels to engage the female connector block with the male pin connector block to power the display panel and align with the plurality of display panels for infrared communication in the daisy chain manner.

16. An electronic sign system comprising:

a. an electronic sign enclosure with a plurality of display panels aligned therein;

b. each of the display panels of the plurality of display panels having an infrared communications module such that a first display panel of the plurality of display panels has a first infrared communications module;

c. the first infrared communications module being aligned to transmit infrared information to a second infrared communications module on a second display panel of the plurality of display panels, which second infrared communications module is aligned to transmit infrared information to another infrared communications module on another display panel of the plurality of display panels, and continuing through the plurality of display panels in a daisy chain manner to communicate to the last display panel of the plurality of display panels; and, d. a master infrared module aligned to transmit infrared information to the first infrared communications module.

17. The electronic sign system of claim 16, wherein each of the display panels of the plurality of display panels detects and displays infrared data information on a display matrix.

18. The electronic sign system of claim 17, wherein the display matrix includes LEDs.

19. The electronic sign system of claim 16, wherein the enclosure aligns each display panel of the plurality of display panels for the daisy chain manner infrared communications.

20. The electronic sign system of claim 19, wherein alignment of the display panels results from a pair of opposed channels provided by the enclosure for each display panel to slide along and a stop bracket to limit sliding of each display panel at an engaged alignment with the enclosure.

21. The electronic sign system of claim 20, wherein a male/female connector is engaged to power each display panel when in engaged alignment with the enclosure.

22. The electronic sign system of claim 21, wherein the male/female connector includes a male pin connector block on the stop bracket and a female connector block on the display panel, the male pin connector block and the female connector block both being oriented for sliding engagement when the display panel is slid along the channels to the stop bracket to engaged alignment with the enclosure.

23. The electronic sign system of claim 22, wherein the enclosure is oriented for vertical sliding of the display panels.

24. The electronic sign system of claim 23, wherein the display panels slide downward to establish engaged alignment with the enclosure.

25. The electronic sign system of claim 16, wherein the display panels of the plurality of display panels are linearly aligned.

26. The electronic sign system of claim 16, wherein the display panels of the plurality of display panels are horizontally aligned.

27. The electronic sign system of claim 16, wherein the master infrared module is mounted to the enclosure so as to align to transmit an infrared signal to the first infrared communication module.

28. The electronic sign system of claim 16, wherein the display panels are interchangeable.

29. The electronic sign system of claim 16, wherein the enclosure includes an access door for each display panel of the plurality of display panels.

30. A sign display system, comprising:

a. an enclosure, having a plurality of front openings, an upper access door for each opening, a pair of opposed vertical channels blocked by the access door when the access door is closed and a stop bracket limiting downward descent on the channels, the channels and stop bracket together defining an aligned engagement for each front opening;

b. a plurality of display panels carried by the enclosure in aligned engagement in the plurality of openings, each of the display panels having an aligned infrared receiver, and an aligned infrared transmitter, and a matrix of LEDs visible through the opening and controlled by infrared data received by the display panel, each of the display panels being vertically removable or descendingly installable when the access door to the opening is opened; and, c. a master infrared transmitter to initiate infrared communications in a daisy chain manner through the plurality of display panels, such that each aligned engaged display panel in the plurality of display panels displays an intended LED matrix display based upon infrared data communication.

31. The sign display of claim 30, wherein the display panels connect to a power supply when in aligned engagement.

32. The sign display of claim 31, wherein the connection to a power supply includes a male/female block connector with vertically oriented pins.

33. A method of displaying a visible message from an electronic sign, the method comprising the steps of:

a. providing a plurality of display panels, each of the display panels of the plurality having an infrared receiver, an infrared transmitter, and selectively actuated LEDs based upon received data information;

b. aligning each of the display panels of the plurality of display panels for successive infrared reception and infrared transmission in a daisy chain manner; and, c. transmitting a master infrared signal to the infrared receiver of a first display panel of the plurality, thereby causing infrared communications in a daisy chain manner and intended displays on each display panel of the plurality of panels.

34. The method of claim 33, wherein the first panel displays a signal based on the received master signal and transmits an IR signal to a subsequent panel of the plurality of display panels.

35. The method of claim 33, wherein the alignment step includes engaging an enclosure.

36. The method of claim 35, wherein the alignment step includes providing and enclosure affording an aligned engagement for each of the display panels of the plurality of display panels.

37. The method of claim 36, wherein the engaging step includes sliding the display into aligned engagement.

38. The method of claim 37, wherein the engaging step includes limiting the sliding.

39. The method of claim 35, wherein the master transmitter is mounted to the enclosure.

40. A method of maintaining an electronic sign, the method comprising the steps of:

a. providing an electronic sign including an enclosure, the enclosure having a plurality aligned engagements, a plurality of display panels adapted for securement in the aligned engagements, each of the display panels having an infrared receiver, and infrared transmitter and a display matrix, wherein the display panels when in aligned engagement, display based upon infrared data received and pass infrared data to a successive display panel, in a daisy chain manner;

b. providing replacement display panels;

c. replacing any defective display panel with a replacement display panel to re-establish the display and daisy chain manner communications.

41. The method of claim 40, wherein the replacing step includes sliding the defective panel from the aligned engagement and sliding the replacement panel into aligned engagement.

* * * * *